US007871131B2

(12) United States Patent
Rowland et al.

(10) Patent No.: US 7,871,131 B2
(45) Date of Patent: Jan. 18, 2011

(54) PANEL

(76) Inventors: David L. Rowland, 739 Park Blvd., Marion, VA (US) 24354-3525; Erwin W. Rowland, 739 Park Blvd., Marion, VA (US) 24354-3525

( * ) Notice: Subject to any disclaimer, the term of this patent is extended or adjusted under 35 U.S.C. 154(b) by 0 days.

(21) Appl. No.: 12/354,419

(22) Filed: Jan. 15, 2009

(65) Prior Publication Data

US 2010/0176646 A1 Jul. 15, 2010

(51) Int. Cl.
*A47C 7/02* (2006.01)

(52) U.S. Cl. ..... 297/452.26; 297/230.11

(58) Field of Classification Search ..... 297/452.38, 297/452.56, 230.11
See application file for complete search history.

(56) References Cited

U.S. PATENT DOCUMENTS 4,062,589 A * 12/1977 Klein et al. ..... 297/450.1
5,393,126 A * 2/1995 Boulva ..... 297/452.56
6,050,646 A * 4/2000 Stenzel et al. ..... 297/452.59
6,345,428 B2 * 2/2002 Apissomian ..... 29/428
6,623,079 B2 * 9/2003 Gregory ..... 297/440.11
6,698,839 B2 * 3/2004 Ballendat ..... 297/440.11
6,886,890 B2 5/2005 Rowland et al.
7,025,424 B2 * 4/2006 Harley ..... 297/452.63
7,055,911 B2 * 6/2006 Simpson et al. ..... 297/440.11

OTHER PUBLICATIONS

International Search Report and Written Opinion issued by the International Searching Authority (ISA/US) on Feb. 12, 2010 in corresponding PCT/US10/20714; 9 pages.

* cited by examiner

*Primary Examiner*—Sarah B McPartlin
(74) *Attorney, Agent, or Firm*—Gable Gotwals

(57) ABSTRACT

A panel having particular utility in a chair or other apparatus for receiving an occupant in a seated position includes an envelope of resilient material having at least one small opening for receiving a substantially rigid and U-shaped envelope support frame. The envelope support frame is inserted into the envelope through the opening and positioned inside the envelope to tension the resilient material of the envelope in one or more tension zones. A rear support frame bar is then inserted into the opening and connected to the envelope support frame. The small opening may then be sewn closed, knitted, or heat sealed. The width of each tension zone when the envelope is in its relaxed state is different than the width of each immediately adjacent tension zone.

10 Claims, 6 Drawing Sheets

14
10
12
16
18
80
18
16
18
18

PANEL

REFERENCE TO PENDING APPLICATIONS

This application is not based upon any pending domestic or international patent applications.

REFERENCE TO MICROFICHE APPENDIX

This application is not referenced in any microfiche appendix.

FIELD OF THE INVENTION

This invention relates generally to panels. More particularly, the present invention relates to a fabric panel for use in items such as chairs, furniture, and luggage.

BACKGROUND OF THE INVENTION

Chairs, furniture and other articles typically include rigid panels which may serve various purposes. For example, many chairs are constructed of seat and backrest panels which are formed or molded substrates onto which a padded composite structure is attached. The chair panels are designed to support the weight of an occupant of the chair with the foam padding being used to provide comfort to the occupant. However, such panels are often bulky and can significantly increase the chair's overall weight while decreasing the chair's stacking and storage density. Solid surface chair panels also provide very little breathability, which contributes negatively to the comfort of the occupant.

Furniture such as dressers and so-called "entertaiment centers" are usually constructed of wood panels having a laminated or varnished exterior finish. These wood panels add tremendous weight to the furniture. Additionally, wood finishes are notoriously susceptible to damage. Most wood furniture panels are not designed to be easily removed and replaced with a new and undamaged panel, so the furniture's wood finish must be maintained in order to keep an aesthetically pleasing appearance.

One approach to resolving the disadvantages of prior art chair panels has been to provide a single-layer elastic membrane that is pre-stretched and mounted to a molded frame. However, the manufacture of such a chair is tremendously complicated and requires a very large molding machine. Also, the structural support and user comfort exhibited by the pre-stretched membranes has been found lacking.

A panel that overcomes problems and disadvantages associated with prior art panels was disclosed in our U.S. Pat. No. 6,886,890. This panel, however, requires a closed-loop frame which must be inserted into an envelope of resilient material having an opening and a fastener that are both substantially equal in size to a side of the closed-loop frame. Because the periphery of the envelope urges against the frame, manufacturing the panel with the closed-loop frame is difficult, time consuming, and costly. In addition, the use of a fastener adds cost and detracts from the aesthetics of the panel. What is needed, therefore, is a panel that overcomes the manufacturing problems and aesthetic concerns associated with the current panel. None of the prior art, alone or in combination, renders the subject matter of the present invention obvious.

BRIEF SUMMARY OF THE INVENTION

The present invention eliminates the difficulties and disadvantages of the prior art by providing a panel having an envelope fabricated from a resilient material and having two openings for accepting a substantially rigid U-shaped envelope support frame and a envelope support frame bar. The two openings are sized slightly larger than a thickness of the U-shaped envelope support frame bar. The U-shaped envelope support frame is inserted into one of the two openings and positioned inside the envelope so as to tension the resilient material of the envelope in one or more tension zones. The envelope support frame bar is then inserted into one of the two openings and then connected to openings in the U-shaped envelope support frame. The two openings may then be sewn shut, knitted, or heat-sealed.

The panel may be configured to include a plurality of tension zones where each tension zone represents a tension on the resilient material that is different than the tension represented by each immediately adjacent tension zone. Tensions applied in the tension zones may all be in a common direction. Use of multiple tension zones in this manner is particularly suitable for panels that carry significant loads, such as the seat panel of a chair or stool.

The envelope may include a first layer of resilient material in opposed relation to a second layer of resilient material. The second layer of resilient material functions to provide overload support when loading on the first layer is sufficient to bring it into contact with the second layer.

When the panel is to be employed in a chair or other apparatus for receiving an occupant in a seated position, the panel is preferably attached to the chair. This may be accomplished by attaching a seat plate to the chair frame, attaching an envelope support frame plate to the envelope support frame, and attaching the support frame plate to the seat plate with a fastener such as a threaded bolt.

A more complete understanding of the invention will be obtained from the following detailed description of the preferred embodiments taken in conjunction with the drawings and attached claims.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENTS

It is to be understood that the invention that is now to be described is not limited in its application to the details of the construction and arrangement of the parts illustrated in the accompanying drawings. The invention is capable of other embodiments and of being practiced or carried out in a variety of ways. The phraseology and terminology employed herein are for purposes of description and not limitation.

Figure 1:
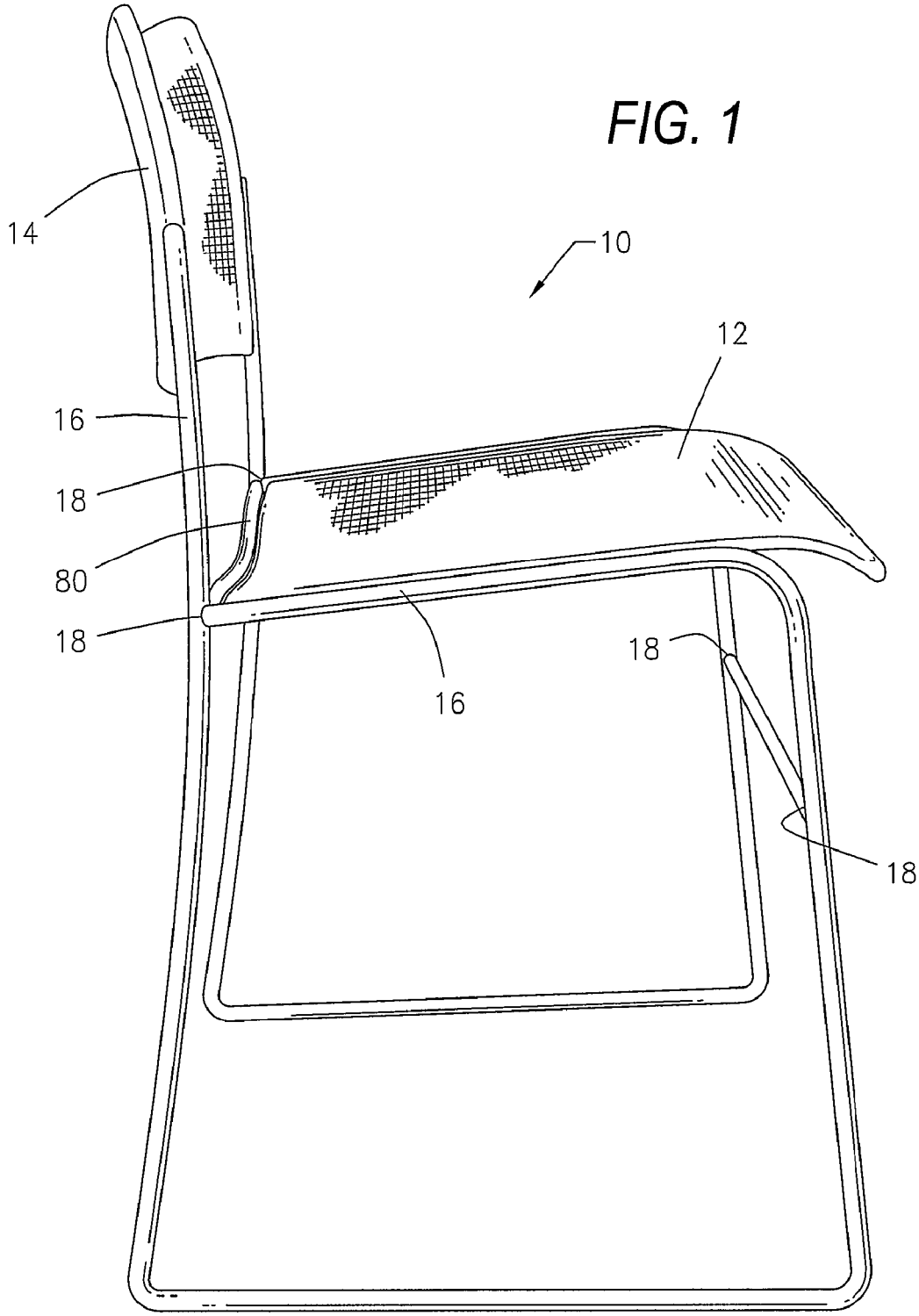
FIG. 1 is a perspective view of a chair having panels according to the present invention.

Referring now to the drawings, FIG. 1 illustrates a chair 10 incorporating a seat panel 12 and a back rest panel 14 attached to a chair frame 16 having a rear frame support 80. The chair frame 16 is fabricated from rod steel with welds at points 18. The seat panel 12 and back rest panel 14 are fabricated from an envelope of resilient material that is stretchable with an internal sub-frame tensioning the material of the envelope in one or more tension zones of the panel, as more fully described below.

It will be understood that the particular chair style illustrated in FIG. 1 is not limiting and that a panel 12, 14 according to the invention may be employed in a variety of devices whose function is to receive an occupant in a seated position. For example, a panel 12, 14 according to the invention may be employed as the seating surface of a stool. Additionally, a panel according to the invention is not limited to use in seating devices and may be employed in various items of furniture, such as dressers and entertainment centers, that require panels as well as numerous other items including luggage and area dividers/partitions.

Figure 2:
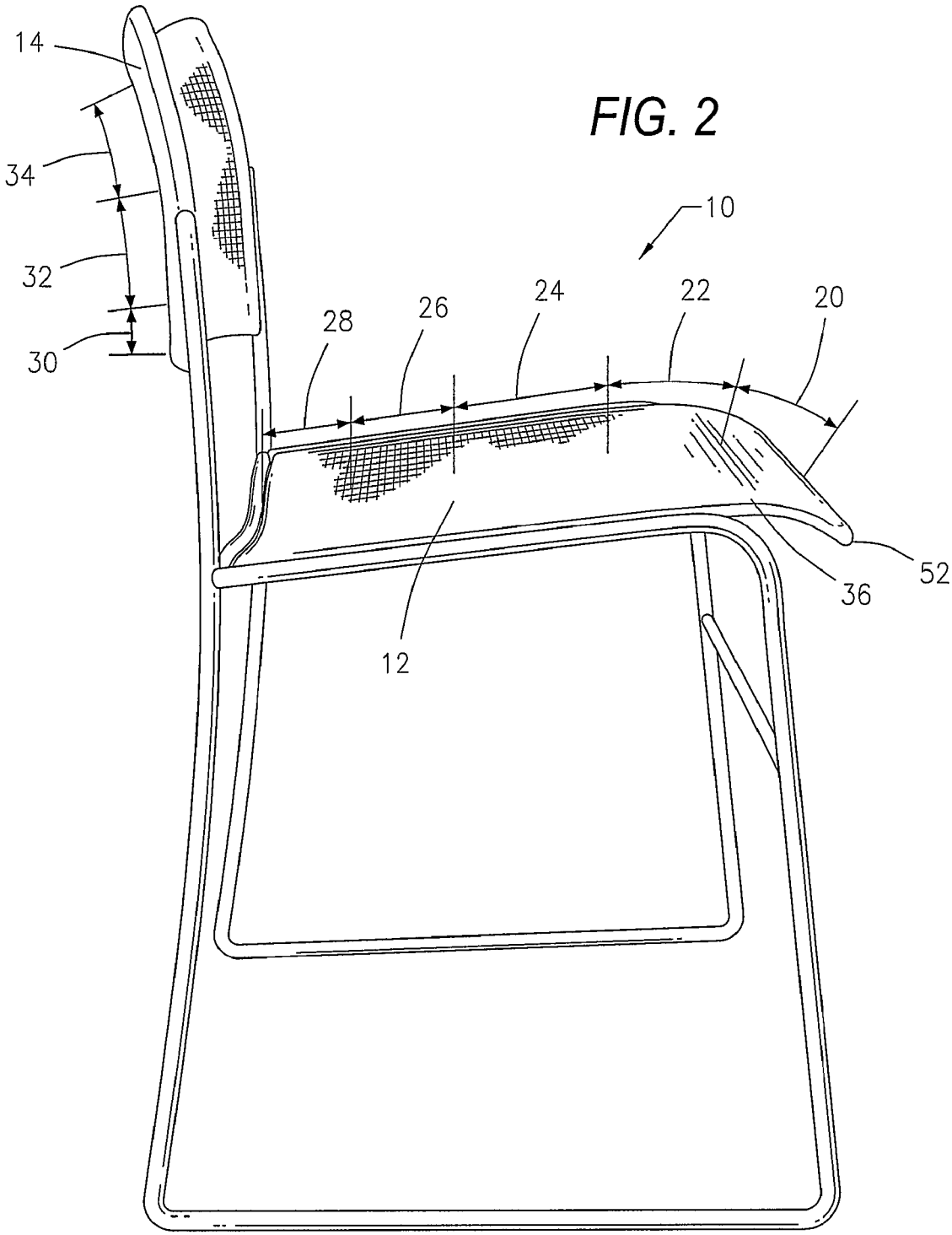
FIG. 2 is a perspective view of the chair of FIG. 1 illustrating various stretch zones in the chair panels.

FIG. 2 illustrates various contiguous tension zones 20-34 representing different loadings or tensions on the resilient material of the panels 12, 14 when an occupant sits in the chair 10. In general, maximum loading is normally experienced in zone 22, which includes the crown 36 of the seat panel 12, and also in zone 26 which includes that portion of the seat panel 12 that supports the occupant's ischial tuberosities. A medium amount of loading is normally experienced in zone 24 where the back of the occupant's thighs are normally supported. Minimal-to-no loading of the seat panel 12 by the occupant is typically experienced in zones 20 and 28.

With regard to the back rest panel 14, maximum loading by the occupant is normally experienced in zone 32 where the occupant's lumbar region is supported. Minimal-to-no loading is typically experienced at zones 30 and 34 of the back rest panel 14.

Figure 3:
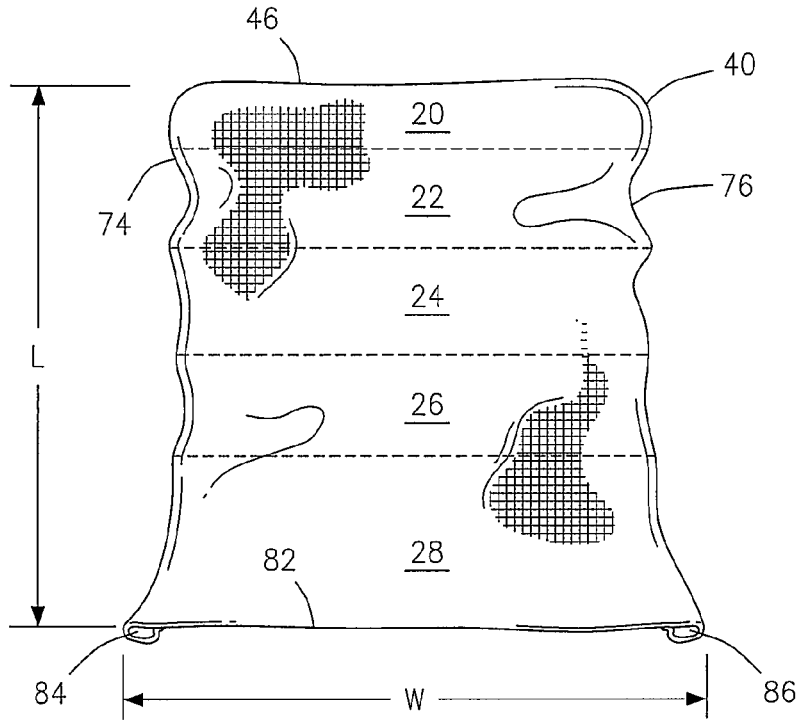
FIG. 3 is a plan view of a fabric envelope.

A preferred embodiment of an envelope 40 used for fabrication of a seat panel 12 is shown in FIG. 3. Although not required in the practice of the invention, the envelope 40 is preferably configured to account for the differential loading by an occupant in zones 20-34 of FIG. 2. This can be accomplished by fabricating the envelope 40 from a resilient material that is stretchable. While many such materials are readily available, a particularly suitable material in this regard is available from the Milliken Company under the trade name C-Flex™, which is fabricated from monofilament fibers having a 672 durometer D-scale value. The C-Flex material has a tensile strength in the warp direction of 156,000 psi and a tensile strength in the filling direction of 194,000 psi. The C-Flex material has the added benefit of high breathability, which significantly enhances occupant comfort.

The envelope 40 is shown in FIG. 3 in its relaxed state and is completely sealed except for two small openings 84, 86. Openings 84 and 86 are slightly larger in diameter than a diameter of a U-shaped sub-frame 50 (see FIG. 4) that is inserted into the envelope 40 through opening 84 or 86. The envelope 40 has a width W at the proximal end 82 that tapers or narrows towards the distal end 46 along at least a portion of the length L of the envelope 40. The relatively narrow body of the envelope 40 results in tension being placed on the envelope's resilient material when the sub-frame 50 is contained within the envelope 40.

Tension placed on the envelope material when the sub-frame 50 is positioned within the envelope 40 may be essentially constant across the length L of the envelope 40. However, in a preferred embodiment as shown in FIG. 3, the envelope 40 is configured so that the level of tension placed on the envelope material with the sub-frame 50 in place varies along the length L of the envelope 40, with each of the different tensions being applied in a common direction. This can be accomplished by varying the width of the relaxed envelope material so that the material is stretched to a greater extent in those portions of the envelope 40 where the width is narrower. For example, the width of the relaxed envelope material in high loading zones 22 and 26 is less than the width in loading zones 20, 24 and 28 where loading is normally less. Also, it is preferable that fabric lines and art work that may be present on the envelope material be deformed commensurate with the contour of the relaxed envelope so that when the sub-frame 50 is positioned within the envelope 40, there is no deformation of the fabric lines or art work in the finished panel 12.

Figure 4:
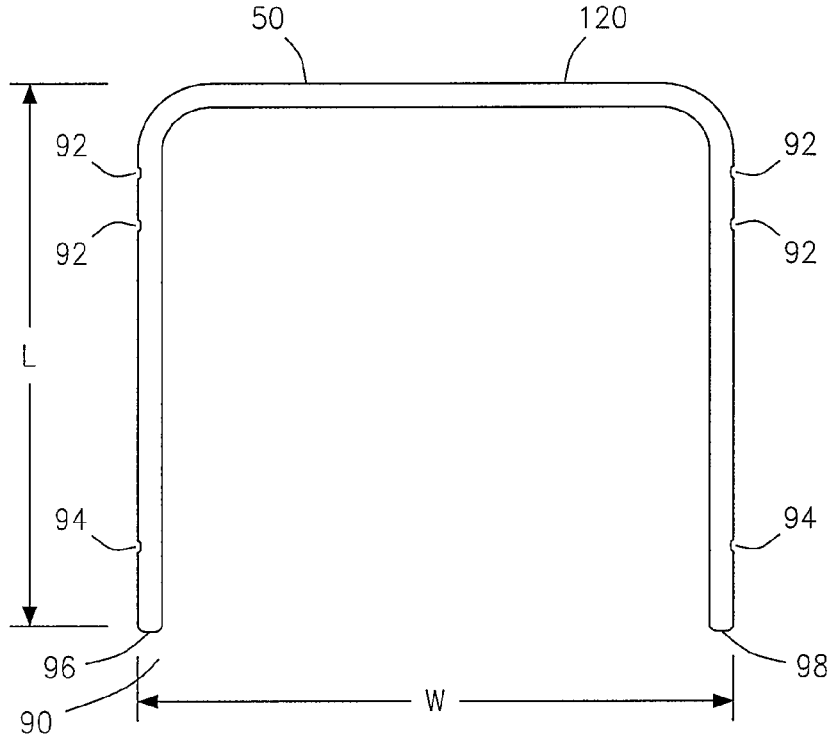
FIG. 4 is a plan view of a panel sub-frame.
Figure 5:
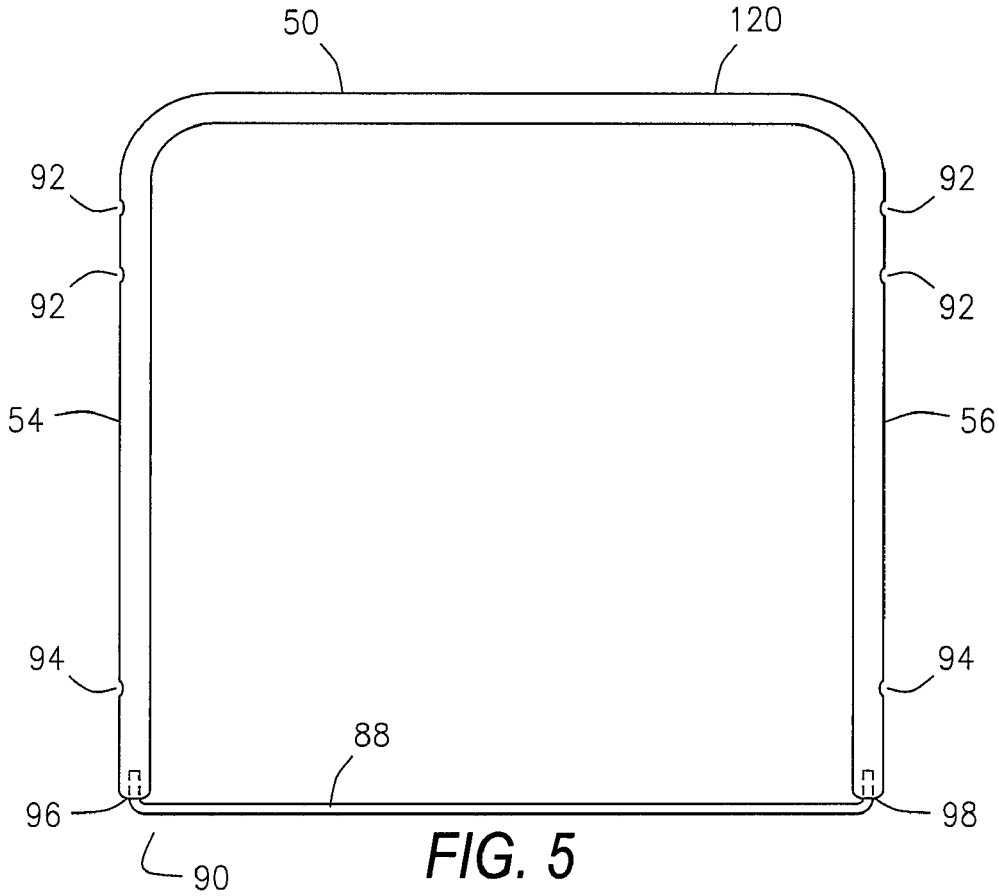
FIG. 5 is a plan view of the panel sub-frame of FIG. 4 with a rear sub-frame bar inserted.
Figure 6:
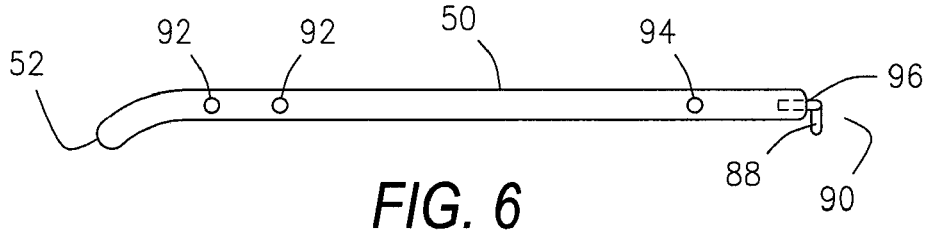
FIG. 6 is a side view of the panel sub-frame of FIG. 4 with the rear sub-frame bar inserted.

With further reference to FIGS. 4, 5, and 6, the envelope of sub-frame 50 is preferably fabricated as a substantially rigid U-shape. The specific U-shape and contour of the sub-frame 50 will depend on the particular application. For example, the sub-frame 50 of FIGS. 4, 5, and 6 is for use in the seat panel 12 shown in FIGS. 1 and 2, so this particular sub-frame 50 is curved downward toward the front edge 52 of the seat panel 12 so that a crown 36 is formed. The sub-frame 50 may be fabricated from a substantially rigid material such as steel or titanium.

Each side 54, 56 of the sub-frame 50 has two pre-drilled holes 92—spaced apart and located toward the distal end 120 of side 54, 56—and one pre-drilled hole 94, located generally near the proximal end 90 of side 54, 56 and forward of a rear sub-frame bar hole 96, 98. The holes 92, 94 are for the purpose of mounting the sub-frame 50 to the chair frame 16. Located on the end face of each side 54, 56 is a rear sub-frame bar hole 96, 98. Rear sub-frame bar holes 96, 98 receive rear sub-frame bar 88. The diameter of rear-sub frame bar 88 is substantially less than the diameter of the rear sub-frame bar holes 96, 98.

Figure 8:
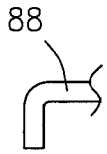
FIG. 8 is a cross-sectional view of the rear sub-frame bar taken along section line 8-8.
Figure 7:
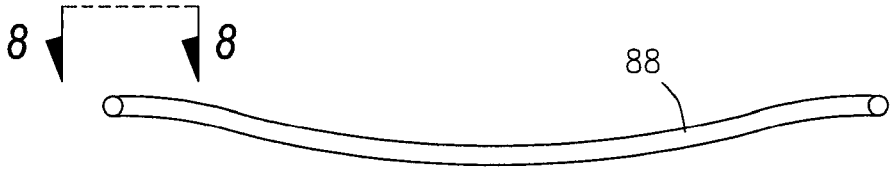
FIG. 7 is a front view of the rear sub-frame bar.

As illustrated in FIGS. 7 and 8, the rear sub-frame bar 88 curves downward from its two ends toward a midpoint of rear sub-frame bar 88. In a preferred embodiment, the contour of rear sub-frame bar 88 is substantially the same as the contour of the rear frame support 80. Each end of the rear sub-frame bar 88 has a right angle bend. Once the sub-frame 50 is positioned within the envelope 40, the rear sub-frame bar is inserted into the envelope 40 through one of the two openings 84, 86 (see FIG. 3). Once contained within the envelope 40, the right angle bend at one end of the rear sub-frame bar 88 is inserted into one of the rear sub-frame bar holes 96, 98; the right angle bend at the other end of the rear sub-frame bar 88 is then inserted into the remaining sub-frame bar hole 96, 98. The tension created as the periphery of the envelope 40 urges against sub-frame 50 holds the rear sub-frame bar 88 in place.

Figure 9:
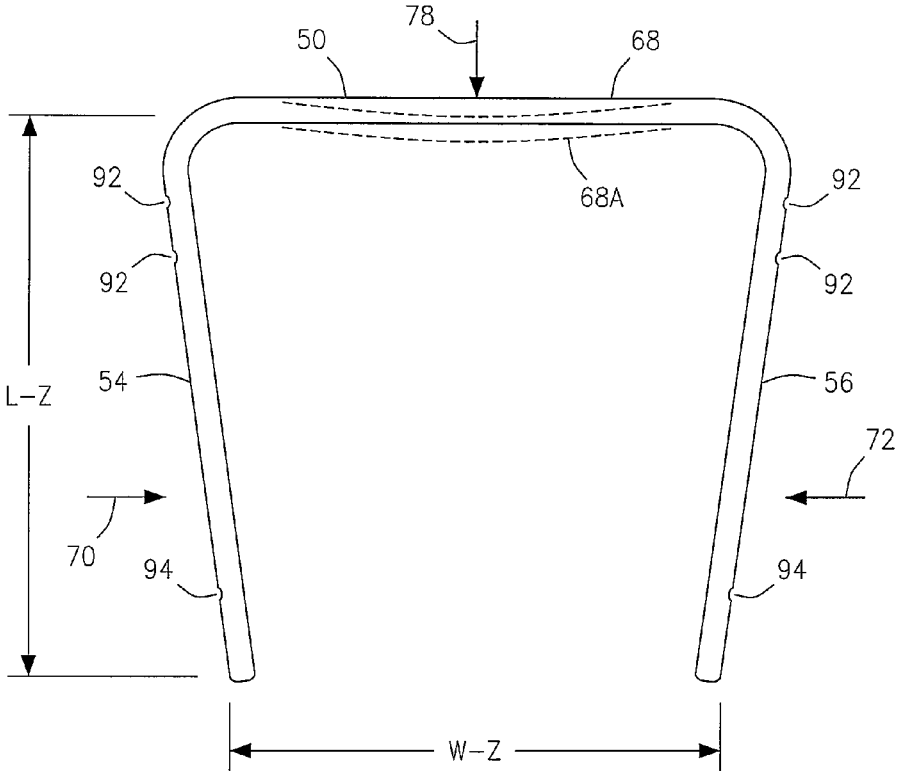
FIG. 9 is a plan view of the panel sub-frame of FIG. 4 illustrating deformation of the panel sub-frame during insertion into the fabric envelope of FIG. 3.

Various methods may be employed to position the sub-frame 50 within the envelope 40. One such method can be described with reference to FIG. 9. The proximal end 90 of one side 54, 56 of the sub-frame 50 is inserted into one of the two openings 84, 86 of the envelope 40. The side 54, 56 is then fed into the interior of the envelope 40. The side 54, 56 continues to be fed into the opening 84, 86 until the proximal end 90 of the opposing side 56, 54 is also contained within the envelope 40. At some point during this process, portions of envelope 40 will be placed in tension as the periphery of envelope 40 urges against the sub-frame 50. By applying force to opposed sides 54, 56 of the sub-frame 50 in the general direction and position indicated by arrows 70, 72, the width W of the sub-frame 50 can be reduced by an amount Z so that the width of the sub-frame 50 becomes W-Z. In a similar fashion, by applying force to side 68 of the sub-frame 50 in the general direction and position indicated by arrow 78, the length L of sub-frame 50 can be reduced by an amount Z so that the length of the sub-frame 50 becomes L-Z. The deformed sub-frame 50 relieves the tension on envelope 40 so that sub-frame 50 can be easily inserted in the envelope 40.

Once sub-frame 50 is completely contained within envelope 40, the sub-frame 50 is released so that the envelope periphery urges against the sub-frame 50. Rear sub-frame bar 88 is then inserted into the envelope 40 through one of the openings 84, 86 and positioned in the rear sub-frame bar holes 96, 98 of sub-frame 50 as previously described. Suitable methods for sealing the openings 84, 86 include sewing, knitting, and the application of heat to fuse the resilient material of the envelope 40.

Use of the particular envelope 40 shown in FIG. 3 results in an assembled panel 12 having a plurality of substantially parallel and contiguous tension zones 20-28 where each tension zone represents a tension on the resilient material of the envelope 40 that is different than the tension represented by each immediately adjacent tension zone. In a preferred embodiment of a seat panel 12 for use in a chair 10 of the type shown in FIGS. 1 and 2, tension zone 20 of the assembled panel 12 will have a tension of about 10 pounds per inch or less, tension zone 22 will have a tension of about 65 pounds per inch, tension zone 24 will have a tension within the range of about 30-35 pounds per inch or less, tension zone 26 will have a tension of about 65 pounds per inch, and tension zone 28 will have a tension of about 10 pounds per inch or less, with each of these tensions being applied in a common direction (i.e., for the envelope 40 of FIG. 3, in a direction substantially parallel with end 46). The use of multiple tension zones 20-28 in the panel 12 eliminates the need for additional support structure beneath or behind the high tension areas with little or no detrimental effect to the occupant's comfort.

Figure 10:
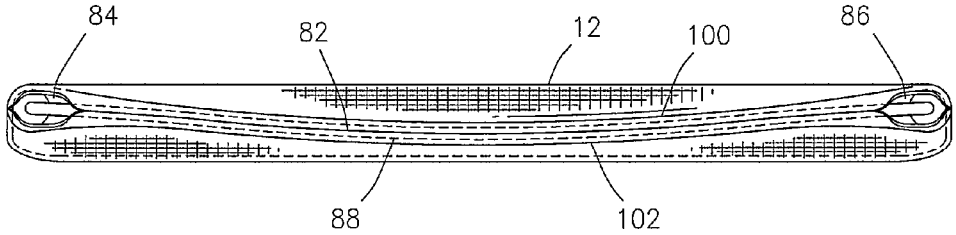
FIG. 10 is an end view of a fabric panel according to the invention.

Referring FIG. 10, the assembled panel 12 includes a top layer 100 of resilient material in opposed relation to a bottom layer 102 of resilient material with the bottom layer 102 providing overload support in the event the top layer 100 receives sufficient loading to bring it into contact with the bottom layer 102. In this regard, the two layers 100, 102 complement one another and provide a significant level of redundancy and integrity to the panel 12.

Figure 11:
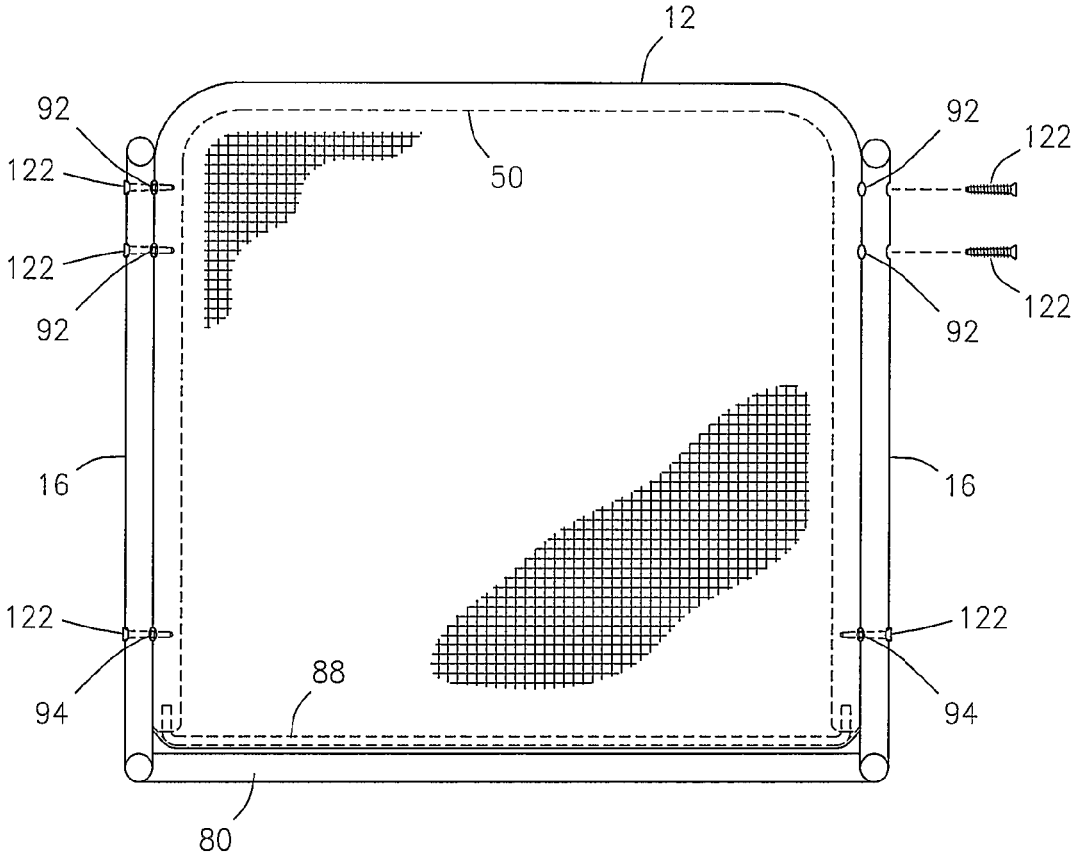
FIG. 11 is a bottom view of the fabric panel mounted to the chair of FIG. 1.

The assembled panel 12 may be attached to the chair frame 16 in a number of ways. FIG. 11 illustrates how the panel 12 can be attached to the chair frame 16 in accordance with a preferred embodiment. The pre-drilled holes 92, 94 of sub-frame 50 are aligned with matching through holes in the seat frame portion of the chair frame 16. Square drive screws 122 then fasten the sub-frame 50 to the chair frame 16.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the above mentioned description is to be considered exemplary, rather than limiting, and the true scope of the invention is that defined in the following claims and any equivalents thereof.

What is claimed is:

1. A panel comprising:

an envelope of resilient material;

an envelope support frame being substantially rigid and having a U-shape, and a bar being connectable to said envelope support frame, said envelope having at least one passageway to an interior of said envelope, said passageway sized so as to receive only a diameter of said envelope support frame, said envelope support frame being positioned inside said envelope through said passageway and when positioned inside said envelope tensioning the resilient material of said envelope in a plurality of contiguous tension zones wherein each tension zone is stretched to a predetermined tautness that is different than the tautness of each immediately adjacent tension zone;

said bar being positioned inside said envelope through said passageway and being connected to said envelope support frame, the tension created by said envelope support frame on said envelope being effective for maintaining said bar in the connected state;

said passageway when sealed enclosing said envelope support frame and said bar completely within said envelope.

2. A panel according to claim 1, each end of said bar having a right angle projection relative to centerline of said bar, said right angle projections being substantially parallel to one another and facing in a common direction relative to the centerline of said bar.

3. A panel according to claim 1 wherein said envelope of resilient material is tensioned in a common direction within each of the tension zones.

4. A panel according to claim 1 wherein the tension in a first tension zone is about 65 pounds per inch and the tension in a second tension zone is about 10 pounds per inch or less.

5. A panel according to claim 1 wherein the tension in a first tension zone is about 65 pounds per inch and the tension in a second tension zone is about 35 pounds per inch or less.

6. A panel according to claim 1 wherein the width of each tension zone when the envelope is in a relaxed state is different than the width of each immediately adjacent tension zone.

7. A panel according to claim 1, further comprising a chair frame attached to said envelope support frame.

8. A panel according to claim 1 further comprising said envelope including a first layer of the resilient material in opposed relation to a second layer of resilient material, said second layer of resilient material providing overload support when loading on the first layer of resilient material causes said first layer of resilient material to contact the second layer of resilient material.

9. A panel according to claim 1 further comprising said plurality of contiguous tension zones being substantially parallel tension zones.

10. A panel according to claim 1 further comprising said envelope support frame being a single piece frame.

* * * * *